US007591052B2

(12) United States Patent
Bovard et al.

(10) Patent No.: US 7,591,052 B2
(45) Date of Patent: Sep. 22, 2009

(54) QUICK CHANGE CASKET ORNAMENT ATTACHMENT MECHANISM

(75) Inventors: Christopher Bovard, Sunman, IN (US); Donald Maple, Batesville, IN (US); Christopher Wessel, Metamora, IN (US)

(73) Assignee: Batesville Services, Inc., Batesville, IN (US)

( * ) Notice: Subject to any disclaimer, the term of this patent is extended or adjusted under 35 U.S.C. 154(b) by 15 days.

(21) Appl. No.: 11/938,274

(22) Filed: Nov. 10, 2007

(65) Prior Publication Data

US 2009/0119893 A1 May 14, 2009

(51) Int. Cl.
*A61G 17/00* (2006.01)

(52) U.S. Cl. ..... 27/10

(58) Field of Classification Search ..... 27/19, 27/10, 2; D99/8, 13; 428/3; 40/600, 621
See application file for complete search history.

(56) References Cited

U.S. PATENT DOCUMENTS 2,213,506 A * 9/1940 Thoresen ..... 27/10
2,712,191 A * 7/1955 Hillenbrand ..... 428/3
3,025,624 A * 3/1962 Harrell ..... 40/124.5
3,115,434 A * 12/1963 Hahn ..... 428/3
3,131,897 A * 5/1964 Shelker et al. ..... 248/27.8
4,571,790 A * 2/1986 James, III ..... 27/10
5,604,965 A * 2/1997 Shaw et al. ..... 27/2
6,138,335 A 10/2000 Drawbaugh et al.
6,317,945 B1 * 11/2001 Laphan et al. ..... 27/10
6,557,222 B2 * 5/2003 Groemminger et al. ..... 27/10
6,591,466 B1 7/2003 Acton et al.
6,691,385 B2 * 2/2004 Bell et al. ..... 27/10
6,928,706 B2 8/2005 Acton et al.
7,260,872 B2 * 8/2007 Schultz ..... 27/10
7,340,810 B2 * 3/2008 Acton et al. ..... 27/10

* cited by examiner

*Primary Examiner*—William L. Miller
(74) *Attorney, Agent, or Firm*—Wood, Herron & Evans, LLP

(57) ABSTRACT

A casket comprises a casket shell, a casket lid closeable on the shell, an ornament, a magnet attached to one of the ornament and the shell, a magnetic object attached to the other of the ornament and shell, and a rotation obstruction on at least one of the ornament and the shell to obstruct rotation of the ornament relative to the shell.

11 Claims, 3 Drawing Sheets

QUICK CHANGE CASKET ORNAMENT ATTACHMENT MECHANISM

FIELD

Figure 1:
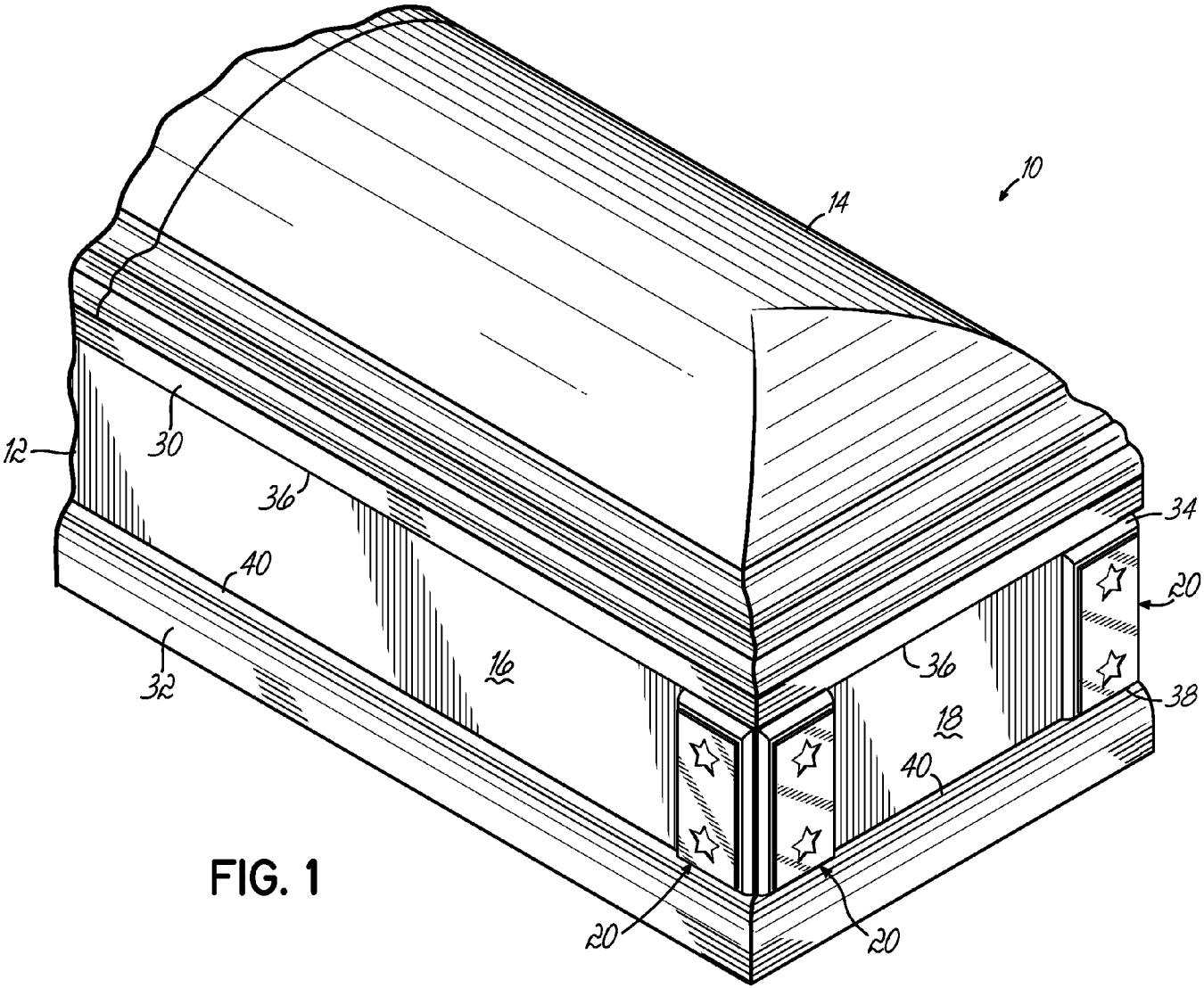

This relates generally to caskets, and, more specifically, to apparatus for attaching decorative ornaments to caskets.

BACKGROUND

Some casket designs incorporate decorative or ornamental corner pieces ("corner ornaments") secured to the casket during fabrication thereof. In many, if not most, prior designs, these corner ornaments are rigidly affixed to the casket shell. Consequently, if a customer purchasing the casket is not pleased with the particular pre-installed corner ornament, and wishes to customize the casket exterior to his or her taste, the funeral director must go through a lengthy and complicated process to first remove the original corner ornaments and then reinstall the corner ornaments chosen by the customer. This process typically requires manual manipulation and access to the interior of the casket which may require the removal of bedding, lining, and the like. Such a process is time consuming and can damage the otherwise new casket and is thus frowned upon and generally avoided by the funeral director.

To more effectively market caskets, the funeral director desires to offer a wide variety of corner ornaments from which a customer can select according to the customer's taste. However, to offer such a wide selection, and to avoid the undesirable practice mentioned above, the funeral director would have to maintain a large inventory of many different casket material/finish and corner ornament combinations, which is also undesirable. To minimize the required inventory of finished caskets, the funeral director could simply have one casket of each material/finish, provided that the funeral director had some means providing for the quick and efficient changing of the corner ornaments on each casket. As such, the customer could quickly view numerous corner ornaments on a single casket, and the funeral director would need only stock a single casket of each material/finish. Prior casket designs, which rigidly affix the corner ornaments, do not permit such quick and efficient changing of the corner ornaments as discussed above.

What is needed, therefore, is an attachment mechanism to permit the quick and efficient installation and removal of corner ornaments onto and from caskets.

One innovation which addresses the aforementioned need is disclosed in the assignee's U.S. Pat. Nos. 6,928,706 and 6,591,466, both hereby incorporated by reference herein. These patents disclose and claim apparatus for removably securing an ornament to a casket shell comprising a first attachment element adapted to be operably associated with the casket, and a second attachment element adapted to be operably associated with the ornament. One of the attachment elements is a keyhole groove having a hole portion and a groove portion, and the other attachment element is a fastener with a head on it that fits in the keyhole groove. The fastener head is inserted into the hole portion and slid into the groove portion. The sides of the groove portion, being narrower than the diameter of the fastener head, retain the fastener head therebehind thereby securing the ornament to the shell. To enhance the security of the connection of the ornament to the shell, the groove can be shaped such that the ornament is removably secured to the shell via motion in first and second non-parallel directions generally parallel to a plane defined by the shell surface to which the ornament is being attached.

Typically a casket includes decorative top mold and base mold at the upper and lower edges, respectively of the sides and ends of the shell. From an aesthetic standpoint it is desirable for the decorative corner ornament to extend completely from the top mold down to the base mold, in other words for the upper surface of the decorative corner ornament to abut the lower surface of the top mold and for the lower surface of the decorative corner ornament to abut the upper surface of the base mold. Depending on the orientation selected for the keyhole groove of the '466 and '706 patents, the direction of movement required to install the corner ornament of the '466 and '706 patents may dictate that the ornament be shorter than the distance between the lower surface of the top mold and the upper surface of the base mold, which as mentioned above is aesthetically undesirable.

It is desirable to provide further innovation in the area of quick change casket ornaments which does not require the ornament to be of a height less than the distance between the lower surface of the top mold and the upper surface of the base mold.

SUMMARY

A casket comprises a casket shell, a casket lid closeable on the shell, an ornament, a magnet attached to one of the ornament and the shell, a magnetic object attached to the other of the ornament and shell, and a rotation obstruction on at least one of the ornament and the shell to obstruct rotation of the ornament relative to the shell.

The shell can include top mold and base mold, and the ornament can be of a height such that an upper edge of the ornament is closely adjacent a lower edge of the top mold and a lower edge of the ornament is closely adjacent an upper edge of the base mold. The obstruction can comprise at least one dowel rod on one of the ornament and the shell and a hole in the other of the ornament and the shell for receiving the dowel rod. The dowel rod can be attached to the ornament and the hole can be in the shell. The dowel rod can be a slip fit in the hole. The magnet can be attached to the ornament and the magnetic object can be attached to the shell. The ornament can have a magnetic cup attached thereto and the magnet can be a disk magnet which is dropped into the cup, the magnetic object can be a magnetic ring, and the disk magnet can have a first contact surface area with the cup and a second contact surface area with the ring, the first surface area can be greater than the second surface area whereby when the ornament is removed from the shell the disk magnet remains in the cup. The ornament can have a countersink in a rear surface thereof, the cup can be installed in the countersink, and the ring can project away from a surface of the shell to which it is attached, such that when the ornament is attached to the shell the ring projects into the countersink.

DRAWINGS

Figure 2:
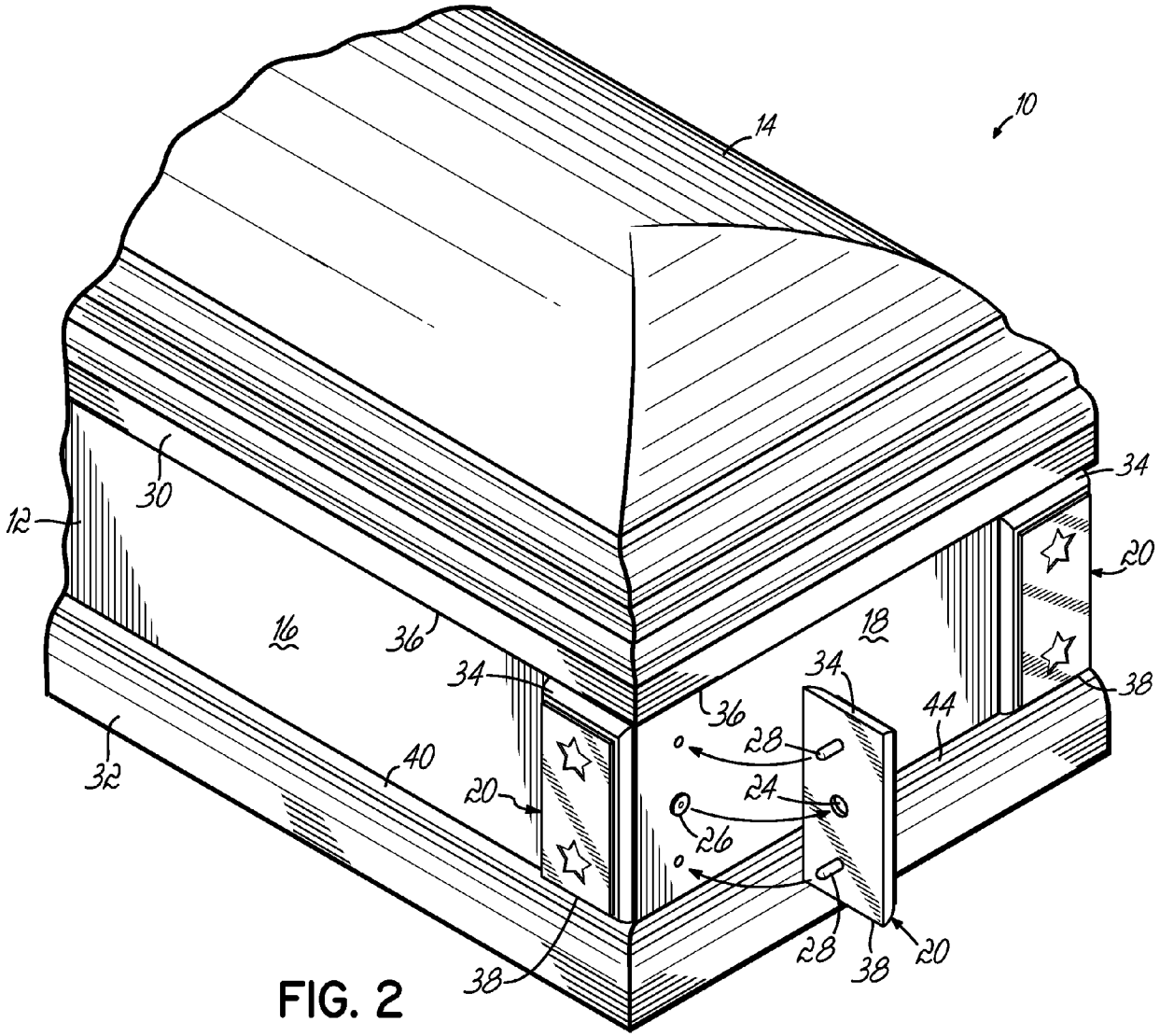
Figure 3:
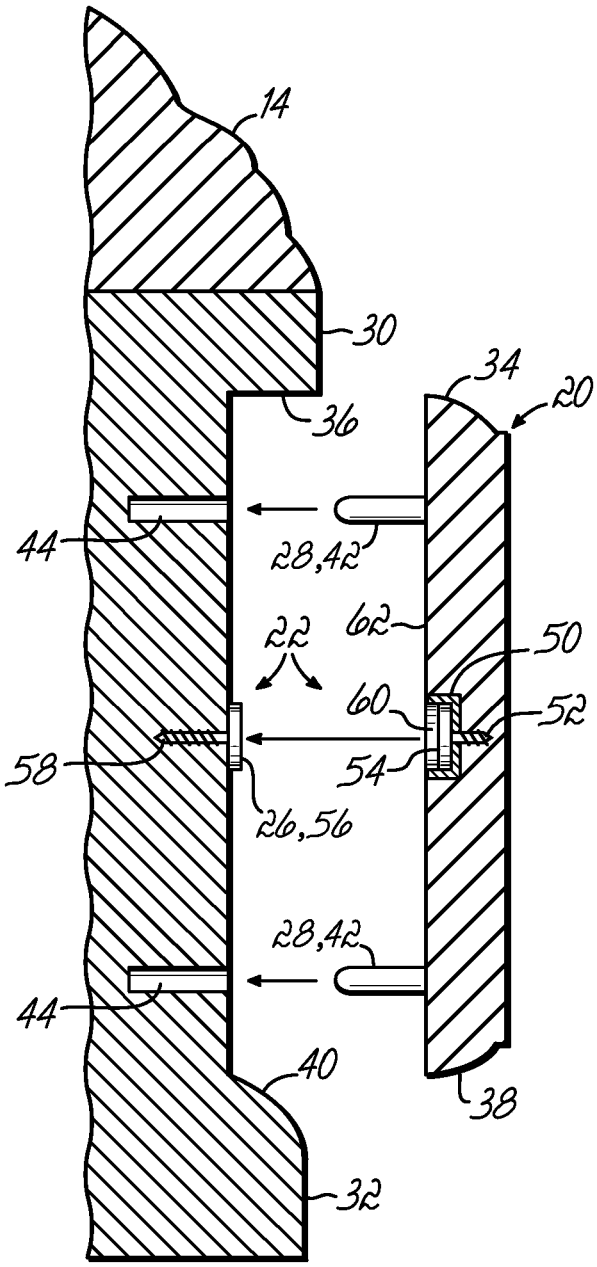
Figure 4:
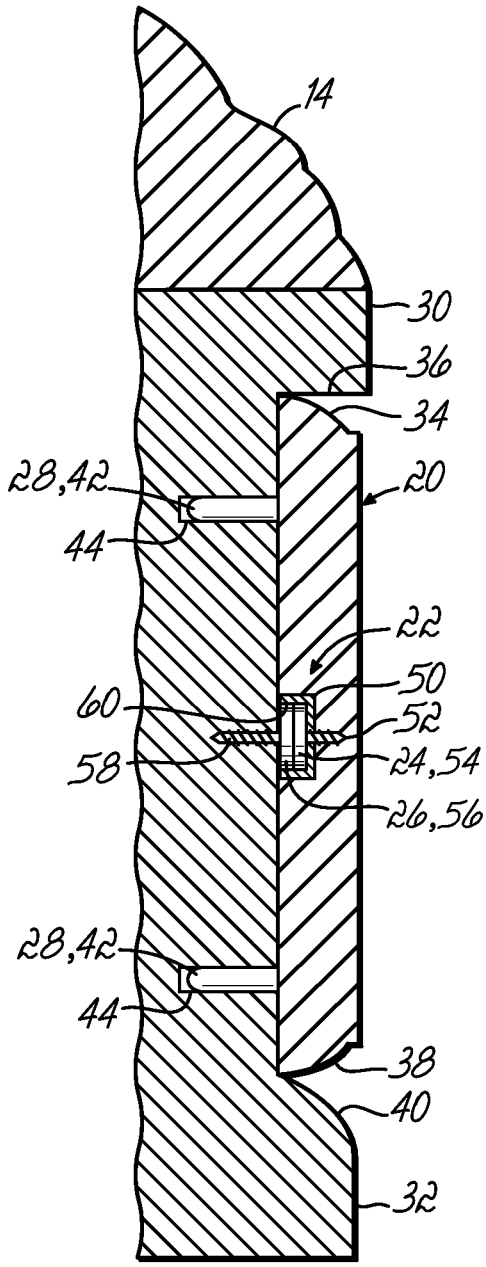

FIG. 1 is a perspective view of a portion of a casket and its ornament attached, FIG. 2 is a view similar to FIG. 1 but with the ornament detached, FIG. 3 is a cross-sectional view of the casket and its ornament detached, and FIG. 4 is a cross-sectional view of the casket and its ornament attached.

DESCRIPTION

With reference to FIG. 1, a casket 10 has a shell 12 and a lid 14 closable on the shell 12. Shell 12 has a pair of oppositely disposed side walls, one of which is shown at 16, and a pair of oppositely disposed end walls, one of which is shown at 18. Ornaments 20 are removably mounted to the shell 12. The casket 10 is illustrated as being made from wood. However, the ornament attachment mechanism which is the subject herein is not limited to use on wooden caskets as it also has utility on metal caskets.

Referring to FIG. 2, ornaments 20 are shown being removably mounted to shell 12 via ornament attachment mechanism 22. Referring to FIGS. 2, 3, and 4, ornament attachment mechanism 22 comprises a magnet 24 attached to one of the ornament 20 and shell 12, a magnetic object 26 attached to the other of the ornament 20 and shell 12, and a rotation obstruction 28 on at least one of the ornament 20 and the shell 12 to obstruct rotation of the ornament 20 relative to the shell 12 to thereby maintain the ornament 20 in the desired orientation and prevent unsightly rotational misalignment of the ornament 20 relative to the shell 12. Magnet 24 can be a permanent magnet. Magnetic object 26 can be fabricated of a ferrous metal or other magnetic metal or material which is attracted by a magnet, or magnetic object 26 can itself be a magnet. Accordingly, the term "magnetic object" shall be construed to embrace all such meanings.

Casket shell 12 can include top mold 30 and base mold 32, and ornament 20 can be of a height such that an upper edge 34 of the ornament 20 is closely adjacent a lower edge 36 of said top mold 30 and a lower edge 38 of the ornament 20 is closely adjacent an upper edge 40 of the base mold 32.

The rotation obstruction 28 can comprise at least one dowel rod 42 on one of the ornament 20 and shell 12 and a hole 44 in the other of the ornament 20 and shell 12 for receiving the dowel rod 42. The dowel rod 42 can be attached to the ornament 20 and the hole 44 can be in the shell 12, as illustrated, or the dowel rod 42 can be attached to the shell 12 and the hole 44 can be in the ornament 20. The dowel rod 42 can be a slip fit in the hole 44. A pair of dowel rods 42 and holes 44, as illustrated, can be used, or a single dowel rod 42 and hole 44.

The magnet 24 can be attached to the ornament 20 and the magnetic object 26 can be attached to the shell 12, as illustrated, or the magnet 24 can be attached to the shell 12 and the magnetic object 26 can be attached to the ornament. The ornament 20 can have a magnetic cup 50 attached thereto as by screw 52, and a disk magnet 54 can be dropped into magnetic cup 50. Magnetic object 26 can be a magnetic disk, ring, or washer 56 attached to shell 12 as by screw 58. The disk magnet 54 can have a first contact surface area with the cup 50 and a second contact surface area with the ring 56, the first surface area being greater than the second surface area whereby when the ornament 20 is removed from the shell 12 the disk magnet 54 remains in the cup 50. The ornament 20 can have a countersink 60 in a rear surface 62 thereof in which to install the cup 50. The ring 56 can project away from a surface 64 of the shell 12 to which it is attached such that when the ornament 20 is attached to the shell 12 the ring 56 projects into the countersink 60 thereby permitting the ornament surface 62 and the shell surface 64 to abut.

The embodiments shown and described are merely for illustrative purposes only. The drawings and the description are not intended to limit in any way the scope of the claims. Those skilled in the art will appreciate various changes, modifications, and alternative embodiments. For example, while the ornaments have been shown as being attached at the corners of the casket shell, the ornaments could be attached to the shell at other locations. And, while the obstruction has been illustrated as being a dowel rod which fits into a hole (or a pair of dowel rods which fit into a pair of holes), other obstructions can be used to obstruct or limit rotation of the ornament relative to the shell. For example, the magnetic attachment and rotation obstruction could be combined. The magnet and magnetic object could interfit, and each could have an appropriate geometry such that when the two are fitted together, they are unable to rotate relative to one another. Or, the magnet and/or magnetic object could interfit with the material of the ornament and/or shell, and each of the magnet and/or magnetic object and the ornament and/or shell could have an appropriate geometry such that when the two are fitted together, they are unable to rotate relative to one another. For another example, the obstruction could be a second magnet and magnetic object, spaced apart from the first magnet and magnetic object. All such changes, modifications and embodiments are deemed to be embraced by the claims.

The invention claimed is:

1. A casket for a deceased comprising:

a casket shell defining an interior for receiving the deceased therein, a casket lid closeable on said shell, an ornament, a magnet attached to one of said ornament and said shell, a magnetic object attached to the other of said ornament and said shell, said ornament thereby magnetically attached to said shell, and a rotation obstruction on at least one of said ornament and said shell to obstruct rotation of said ornament relative to said shell, wherein said rotation obstruction comprises at least one dowel rod on one of said ornament and said shell and a hole in the other of said ornament and said shell for receiving said dowel rod.

2. The casket of claim 1 wherein said shell includes top mold and base mold, and wherein said ornament is of a height such that an upper edge of said ornament is closely adjacent a lower edge of said top mold and a lower edge of said ornament is closely adjacent an upper edge of said base mold.

3. The casket of claim 1 wherein said dowel rod is attached to said ornament and said hole is in said shell.

4. The casket of claim 3 wherein said dowel rod is a slip fit in said hole.

5. The casket of claim 1 wherein said magnet is attached to said ornament and said magnetic object is attached to said shell.

6. The casket of claim 5 wherein:

said ornament has a magnetic cup attached thereto and said magnet is a disk magnet which is dropped into said cup, said magnetic object is a magnetic ring, and said disk magnet has a first contact surface area with said cup and a second contact surface area with said ring, said first surface area being greater than said second surface area whereby when said ornament is removed from said shell said disk magnet remains in said cup.

7. The casket of claim 6 wherein said ornament has a countersink in a rear surface thereof, said cup is installed in said countersink, and wherein said ring projects away from a surface of said shell to which it is attached, such that when said ornament is attached to said shell said ring projects into said countersink.

8. A casket for a deceased comprising:

a casket shell defining an interior for receiving the deceased therein, a casket lid closeable on said shell, an ornament magnetically attached to said shell, and a projection on one of said shell and said ornament and a recess in the other of said shell and said ornament for receiving said projection to obstruct rotation of said ornament relative to said shell.

9. The casket of claim 8 wherein said ornament is a corner ornament.

10. The casket of claim 8 wherein said projection is a rod and wherein said recess is a hole.

11. The casket of claim 10 wherein said rod is attached to said ornament and said hole is formed in said shell.

* * * * *